US011617039B2

(12) United States Patent
Ilkorur et al.

(10) Patent No.: US 11,617,039 B2
(45) **Date of Patent: *Mar. 28, 2023**

(54) PLANAR MAGNETIC DRIVER HAVING TRACE-FREE RADIANT REGION

(71) Applicant: APPLE INC., Cupertino, CA (US)

(72) Inventors: Onur I. Ilkorur, Campbell, CA (US); Miikka O. Tikander, Los Gatos, CA (US); Christopher Wilk, Los Gatos, CA (US); Bonnie W. Tom, San Leandro, CA (US)

(73) Assignee: APPLE INC., Cupertino, CA (US)

( * ) Notice: Subject to any disclaimer, the term of this patent is extended or adjusted under 35 U.S.C. 154(b) by 15 days.

This patent is subject to a terminal disclaimer.

(21) Appl. No.: 17/175,496

(22) Filed: Feb. 12, 2021

(65) Prior Publication Data

US 2021/0185450 A1 Jun. 17, 2021

Related U.S. Application Data

(63) Continuation of application No. 16/144,813, filed on Sep. 27, 2018, now Pat. No. 10,959,024.

(51) Int. Cl.

| | |
|---|---|
| ***H04R 9/02*** | (2006.01) |
| ***H04R 9/06*** | (2006.01) |
| ***H04R 7/16*** | (2006.01) |

(52) U.S. Cl.

CPC ..... *H04R 9/025* (2013.01); *H04R 7/16* (2013.01); *H04R 9/063* (2013.01); *H04R 2209/026* (2013.01); *H04R 2499/11* (2013.01)

(58) Field of Classification Search

CPC ..... H04R 9/025; H04R 7/16; H04R 9/063; H04R 2209/026; H04R 2499/11

See application file for complete search history.

(56) References Cited

U.S. PATENT DOCUMENTS 6,409,413 B1 * 6/2002 Bieg ..... F16C 11/0619 403/114
10,037,752 B1 * 7/2018 Colasante ..... G10K 11/22
(Continued)

FOREIGN PATENT DOCUMENTS

| | | |
|---|---|---|
| CN | 205105389 U | 3/2016 |
| CN | 205510402 U | 8/2016 |
| TW | M290647 U | 5/2006 |

OTHER PUBLICATIONS

Chinese Notice of Allowance from related Chinese Application No. 201910781050.0 dated Jul. 16, 2021 (5 pages).

*Primary Examiner* — Alexander Krzystan
*Assistant Examiner* — Julie X Dang
(74) *Attorney, Agent, or Firm* — Womble Bond Dickinson (US) LLP

(57) ABSTRACT

A planar magnetic driver including a radiating surface having a trace-free central region is described. The driver has a magnet defining an acoustic opening on a central axis. A diaphragm of the planar magnetic driver is held by mounts having a mounting profile around the central axis, and the diaphragm includes a radiating surface facing the acoustic opening. An innermost conductive trace on the diaphragm extends around a central region of the radiating surface within a magnetic flux of the magnet such that no conductive traces are on the central region. A radial distance between the innermost conductive trace and the mounting profile is less than another radial distance between the innermost conductive trace and the central axis. Accordingly, an excursion range of the diaphragm along the central axis is greater than a gap distance between the conductive trace and the magnet. Other aspects are also described and claimed.

20 Claims, 6 Drawing Sheets

(56) References Cited

U.S. PATENT DOCUMENTS

| | | | | |
|---|---|---|---|---|
| 10,959,024 | B2 * | 3/2021 | Ilkorur | H04R 9/025 |
| 2003/0133581 | A1 | 7/2003 | Klayman | |
| 2006/0067553 | A1 * | 3/2006 | Manrique | H04R 1/02 381/116 |
| 2006/0210099 | A1 * | 9/2006 | Takahata | H04R 1/02 381/152 |
| 2010/0278361 | A1 | 11/2010 | Simidian, II et al. | |
| 2015/0181341 | A1 | 6/2015 | Azmi | |
| 2016/0052017 | A1 * | 2/2016 | Weber | H04R 1/023 156/60 |
| 2016/0212546 | A1 * | 7/2016 | Salvatti | H04R 9/06 |
| 2016/0286650 | A1 * | 9/2016 | Gingrich, III | H01H 13/70 |
| 2017/0188156 | A1 * | 6/2017 | Epping | H04R 9/025 |

* cited by examiner

PLANAR MAGNETIC DRIVER HAVING TRACE-FREE RADIANT REGION

This patent application is a continuation application of U.S. patent application Ser. No. 16/144,813, filed Sep. 27, 2018, entitled "Planar Magnetic Driver Having Trace-Free Radiating Region", and the content of that patent application is incorporated by reference herein in its entirety.

BACKGROUND INFORMATION

Field

Aspects related to a speaker driver are disclosed. More particularly, aspects related to a planar magnetic driver having conductive traces around a region of a radiating surface of a diaphragm are disclosed A speaker driver is a transducer that converts an electrical input audio signal into an emitted sound. One type of speaker driver is a planar magnetic driver. Planar magnetic drivers typically include a voicecoil on a planar film, which is placed between a pair of magnet assemblies. An audio signal is conducted through the voicecoil to cause the planar film to oscillate within a magnetic field of the magnet assemblies. The oscillating planar film can generate and emit sound.

Typically, the voicecoil of planar magnetic drivers includes conductive traces that extend across a radiating surface of the planar film. The radiating surface generates sound by oscillating during driver operation. The conductive traces may start on the radiating surface radially outward from a center of the planar film, and extend along a spiral or serpentine pattern toward the center. The trace pattern extends over the center, or over a central region, of the planar film and covers the radiating surface of the diaphragm. In some cases, a grill or acoustic wave guide is located over the radiating surface of the diaphragm.

SUMMARY

Existing planar magnetic drivers have several drawbacks. For example, traditional planar magnetic drivers have diaphragms located between a pair of magnet assemblies. The pair of magnet assemblies and corresponding traces on the diaphragm typically extend over a center of the diaphragm. This placement can limit movement of the diaphragm, which forces a tradeoff between acoustic range and driver efficiency. For example, a gap between the magnet and the diaphragm can be increased to allow the diaphragm to deflect more and generate lower frequency sounds, however, widening the gap also separates the magnet from the traces more, which can reduce an efficiency of the magnet-trace system. Furthermore, the magnet assemblies can degrade sound traveling along an acoustic radiation path from the radiating surface of the diaphragm. For example, the magnets can obscure the radiation path and block the sound. Similarly, the sound may pass through openings in the magnet assemblies, and the openings may act like resonator necks, causing standing waves to develop within the openings that further distorts the sound. An additional drawback is that the centrally located windings of existing planar magnetic drivers cover the central region of the radiating surface, which reduces visibility through the diaphragm. The reduced visibility makes existing planar magnetic drivers unsuitable for applications that would benefit from an ability to see through the diaphragm.

A speaker driver, and devices incorporating the speaker driver, are described. In an aspect, the speaker driver is a planar magnetic driver. The planar magnetic driver includes a diaphragm mounted on one or more mounts having a mounting profile that extends around a central axis. The driver includes one or more magnets, e.g., a pair of ring magnets, that extend around the central axis to define an acoustic opening that is radially inward from the mounting profile. The diaphragm has a radiating surface that faces the acoustic opening, and a central region of the radiating surface is radially inward of an inner surface of the magnets that define the acoustic opening. More particularly, the driver has conductive traces on the diaphragm, and an innermost trace extends around the central region of the radiating surface adjacent to an inner dimension of the magnet. Accordingly, the central region of the radiating surface is trace-free (no conductive traces are on the radiating surface over the central region) and is radially inward from the magnet. The trace-free central region of the radiating surface is axially aligned with the acoustic opening to generate sound that propagates through the acoustic opening into a surrounding environment when the driver is driven with an audio signal.

In an aspect, a magnetic gap is located between the pair of magnets, and a distance across the gap is less than an excursion range of the diaphragm. For example, when the diaphragm is excited, a center of the diaphragm moves between upper and lower limits that are separated by the excursion range. The excursion range can be greater than the gap distance in part because the magnets are located nearer to an outer perimeter of the diaphragm than the center of the diaphragm. More particularly, a radial distance between the center and the innermost trace on the diaphragm (or the inner dimension of the magnet) can be greater than a radial distance between the outer perimeter and the innermost trace (or the inner dimension of the magnet). Exciting the diaphragm from the outer region of the diaphragm, and not covering the acoustic opening with grills or acoustic waveguides, allows the center of the diaphragm to deflect substantially higher than the magnet surfaces facing the magnetic gap. Accordingly, air volume displacement and sound generation is increased. Furthermore, by not covering the acoustic opening with grills or acoustic waveguides, the distortion of the generated sound can be reduced.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
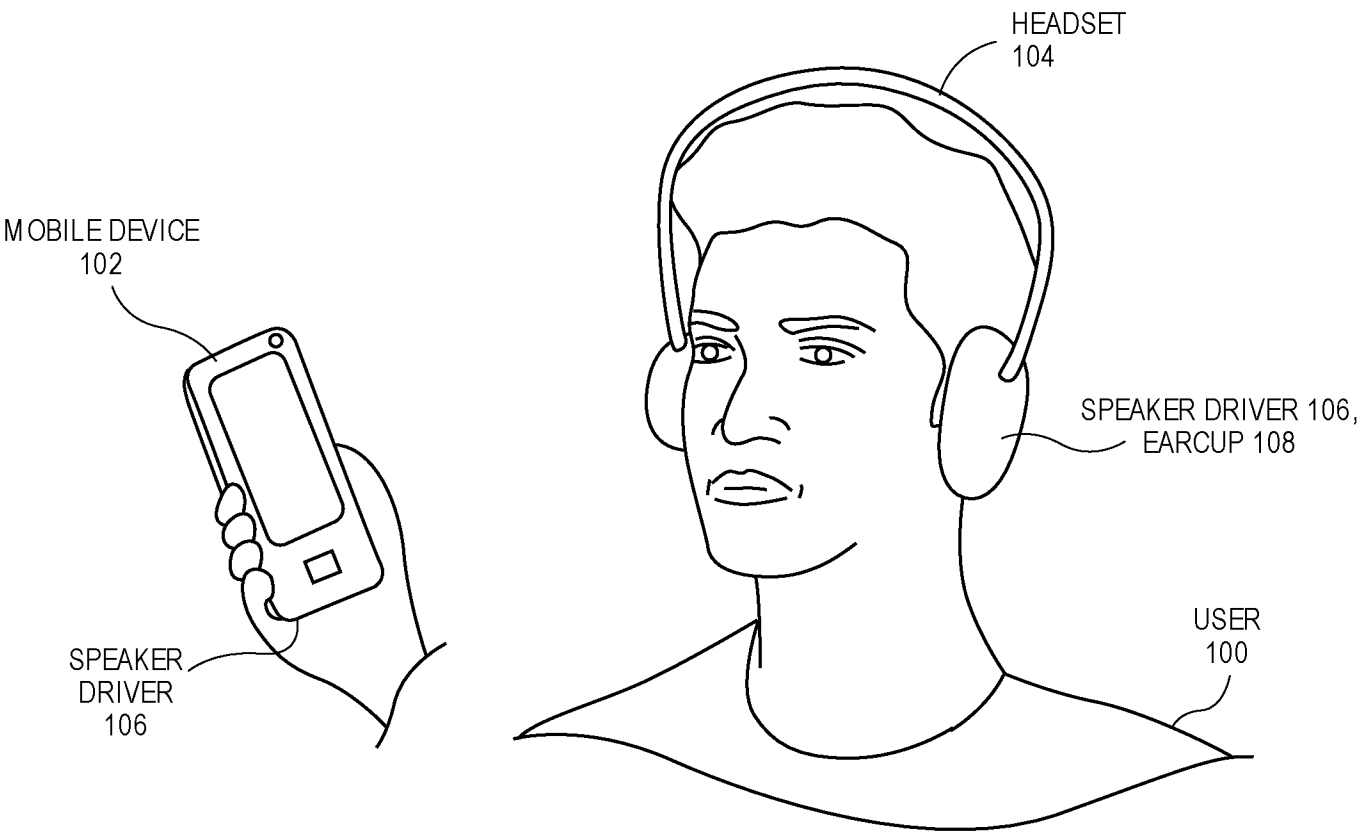
FIG. 1 is a pictorial view of a user listening to a speaker driver, in accordance with an aspect.

Aspects describe a speaker driver including a radiating surface having a trace-free region. The speaker driver can be a planar magnetic driver incorporated into a mobile device or a headset. In an aspect, the mobile device can be a smartphone and the headset can be circumaural headphones. The headset can include other types of headphones, such as earbuds or supra-aural headphones, to name only a few possible applications. In other aspects, the mobile device can be another device for rendering media including audio to a user, such as a desktop computer, a laptop computer, augmented reality/virtual reality headset, etc.

In various aspects, description is made with reference to the figures. However, certain aspects may be practiced without one or more of these specific details, or in combination with other known methods and configurations. In the following description, numerous specific details are set forth, such as specific configurations, dimensions, and processes, in order to provide a thorough understanding of the aspects. In other instances, well-known processes and manufacturing techniques have not been described in particular detail in order to not unnecessarily obscure the description. Reference throughout this specification to "one aspect," "an aspect," or the like, means that a particular feature, structure, configuration, or characteristic described is included in at least one aspect. Thus, the appearance of the phrase "one aspect," "an aspect," or the like, in various places throughout this specification are not necessarily referring to the same aspect. Furthermore, the particular features, structures, configurations, or characteristics may be combined in any suitable manner in one or more aspects.

The use of relative terms throughout the description may denote a relative position or direction. For example, "above" may indicate a location in a first direction away from a reference point. Similarly, "below" may indicate a location in a second direction away from the reference point and opposite to the first direction. Such terms are provided to establish relative frames of reference, however, and are not intended to limit the use or orientation of a speaker driver to a specific configuration described in the various aspects below.

In an aspect, a speaker driver includes a diaphragm mounted within a magnetic gap of a pair of magnets. The diaphragm carries conductive traces, and an innermost conductive trace extends around a central region of a radiating surface of the diaphragm, which faces an acoustic opening defined by one or more of the magnets. The central region of the radiating surface is trace-free because it is radially inward from the innermost conductive trace. Furthermore, the traces on the diaphragm can be located toward an outer perimeter of the diaphragm such that the diaphragm is excited from the outer perimeter when the conductive traces are driven. For example, a first radial distance between the innermost conductive trace and mounting locations along the outer perimeter of the diaphragm can be less than a second radial distance between the innermost conductive trace and a center of the diaphragm. Exciting the diaphragm from the outer perimeter allows the center of the diaphragm to deflect through an excursion range that is larger than a distance across the magnetic gap, when the speaker driver is driven with an audio signal.

Referring to FIG. 1, a pictorial view of a user listening to a speaker driver is shown in accordance with an aspect. A user 100 may listen to sounds generated by a mobile device 102 or a headset 104. For example, mobile device 102 can be a smartphone, a laptop, a portable speaker, etc., having a speaker driver 106 to play sounds. Similarly, headset 104 can be circumaural headphones, supra-aural headphones, earbuds, etc., having speaker driver 106 to play sounds directly into an ear of user 100. Speaker driver 106 can be mounted in an earcup 108, and earbud, etc., of headset 104. The generated sounds correspond to audio signals driving speaker driver 106, such as an audio signal representing music, binaural audio reproductions, phone calls, etc.

In an aspect, mobile device 102 and/or headset 104 includes circuitry to perform the functions described below. For example, either device includes speaker driver 106, which can be a planar magnetic driver to generate sounds. Planar magnetic driver 106 can be, for example, a high-quality, broadband speaker capable of emitting predetermined sounds generated based on known audio signals. Mobile device 102 and headset 104 can also include mechanical structures, such as a housing, a headband, or a neck cord to connect several speaker drivers together.

Figure 2:
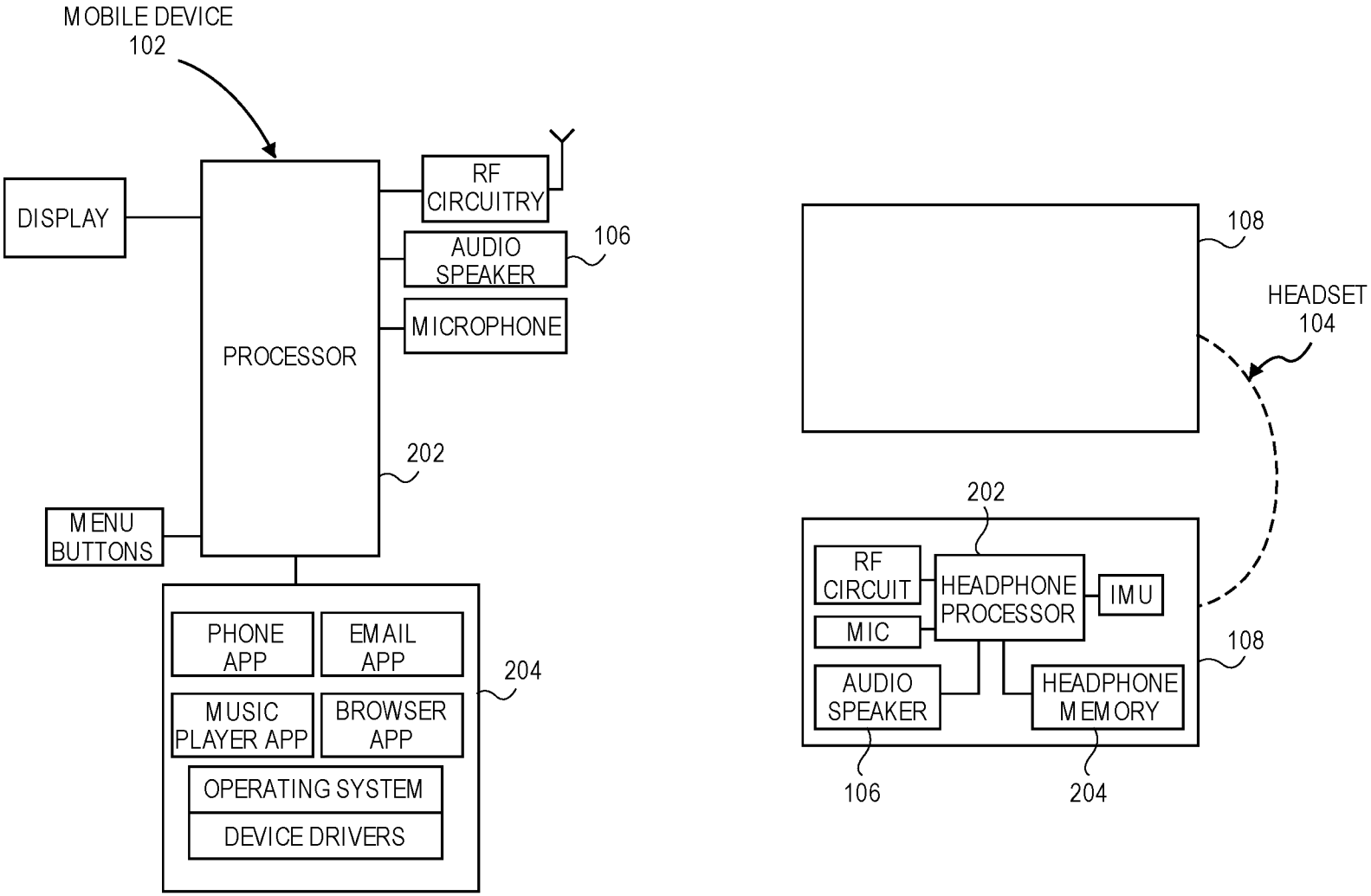
FIG. 2 is a block diagram of a speaker driver incorporated into devices, in accordance with an aspect.

Referring to FIG. 2, a block diagram of a speaker driver incorporated into devices is shown in accordance with an aspect. Mobile device 102 can include one or more device processors 202 to execute instructions to carry out the different functions and capabilities described below. Instructions executed by device processor(s) 202 may be retrieved from a device memory 204, which may include a non-transitory machine readable medium. The instructions may be in the form of an operating system program having device drivers and/or an audio rendering engine for rendering music playback, binaural audio playback, etc. The instructions can also pertain to telephony applications, email applications, browser applications, etc., running on mobile device 102. Audio from the running applications can be played by speaker driver 106 of mobile device 102. More particularly, device processor(s) 202 can be configured to drive speaker driver 106 with an audio signal.

To perform the various functions, device processor(s) 202 may directly or indirectly implement control loops and receive input signals from, and/or provide output signals to, other electronic components. For example, device processor(s) 202 may receive input signals from microphone(s) or menu buttons of mobile device 102, including through input selections of user interface elements displayed on a display.

In an aspect, headset 104 includes one or more headset processors 202 to execute instructions to carry out the different functions and capabilities described below. Instructions executed by headset processor(s) 202 may be retrieved from a headset memory 204, which may include a non-transitory machine readable medium. The instructions may be in the form of an operating system program having device drivers and/or an audio rendering engine for rendering music playback, binaural audio playback, etc., according to the methods described below. In an aspect, headset memory 204 stores audio data, e.g., a cached portion of audio data received from mobile device 102 via respective RF circuitry. Headset processor 202 can receive the cached portion and render the audio through speaker driver 106. More particularly, headset processor(s) 202 can be configured to drive audio speaker with an audio signal.

To perform the various functions, headset processor(s) 202 may directly or indirectly implement control loops and receive input signals from, and/or provide output signals to, other electronic components. For example, headset processor(s) 202 may receive input signals from microphone(s) or inertial measurement unit(s) (IMU) of headset 104.

Figure 3:
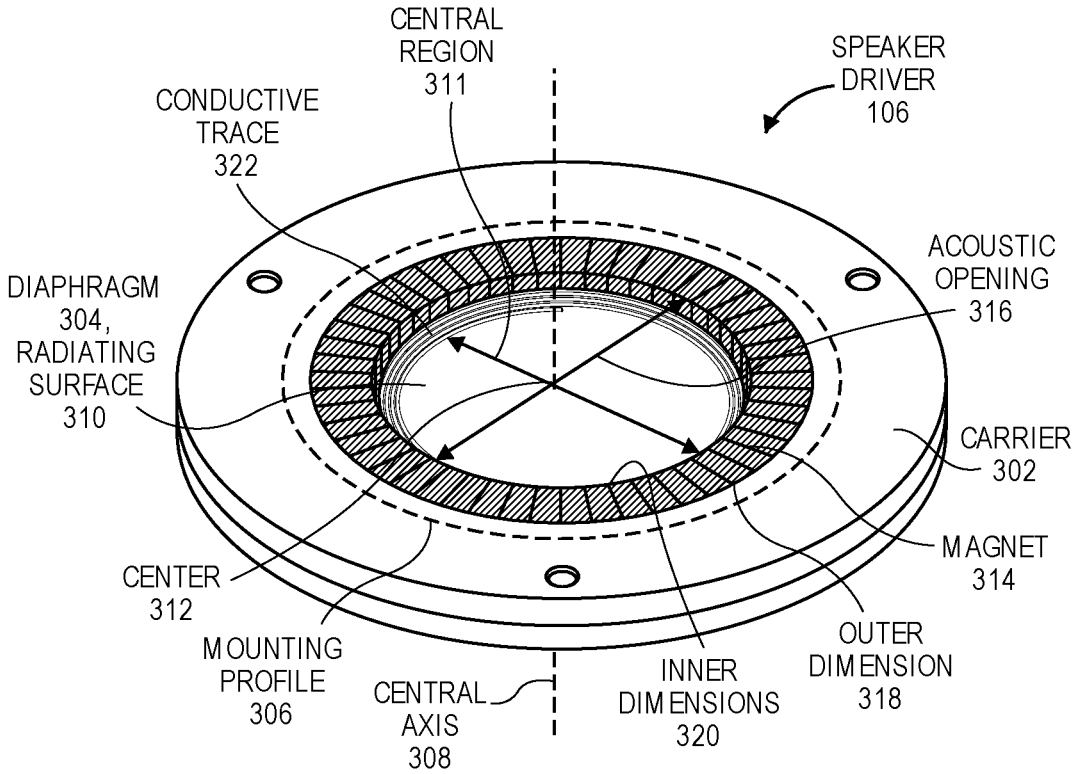
FIG. 3 is a perspective view of a planar magnetic driver, in accordance with an aspect.
Figure 4:
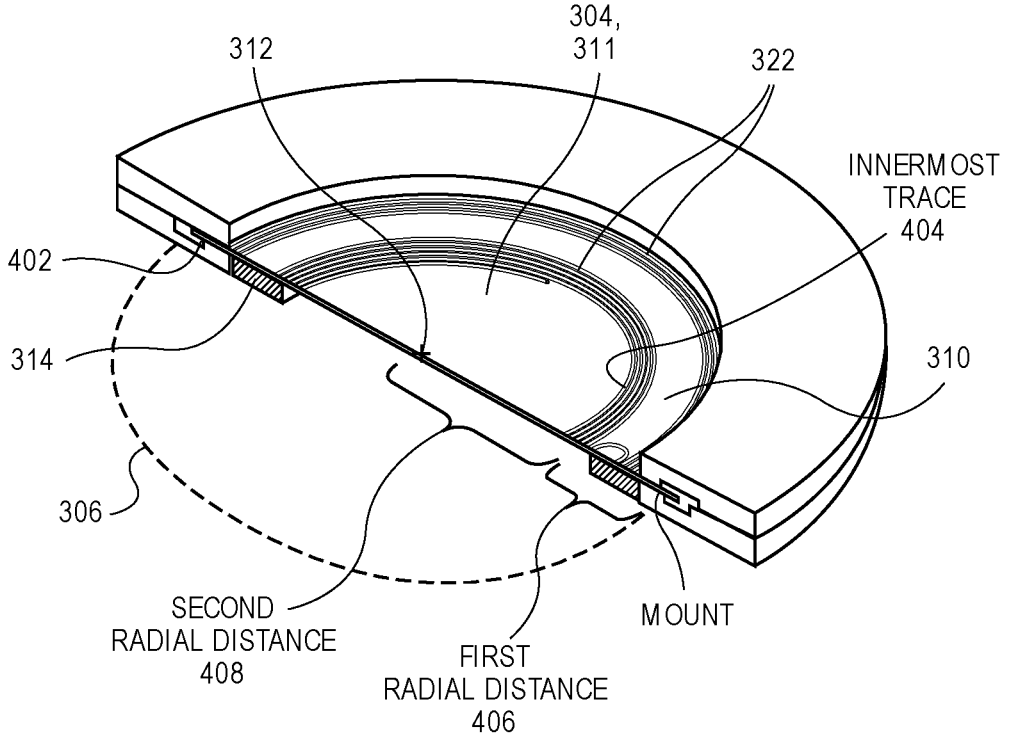
FIG. 4 is a perspective sectional view of a planar magnetic driver, in accordance with an aspect.

Referring to FIG. 3, a perspective view of a planar magnetic driver is shown in accordance with an aspect. Speaker driver 106 incorporated in mobile device 102, headset 104, or any other device or apparatus, can be a planar magnetic driver 106. Planar magnetic driver 106 can include a carrier 302 that allows speaker driver 106 to be mounted on another component of a device (e.g., a device housing of mobile device 102 or earcup 108 of headset 104. Carrier 302 can hold other components of the driver 106. For example, a diaphragm 304, which can be a planar diaphragm, of speaker driver 106 may be mounted on one or more mounts (FIG. 4). The mounts can that connect diaphragm 304 to carrier 302 along a mounting profile 306. Mounting profile 306 can be a reference geometry (shown by dashed lines) along which diaphragm 304 is attached to carrier 302. Mounting profile 306 can extend around a central axis 308, and thus, diaphragm 304 can be secured at mounting locations surrounding central axis 308. Diaphragm 304 can extend across central axis 308 between the mounting locations. More particularly, central axis 308 may intersect an upper or lower surface of diaphragm 304. For example, the upper or lower surface can be a radiating surface 310. Radiating surface 310 can be a region of diaphragm that is in motion when an electrical signal is applied to the transducer, as described below. Radiating surface 310 can have several sections or regions. In an aspect, a central region 311 is a portion of radiating surface 310 that is trace-free. Central axis 308 may extend orthogonal to a center 312 of diaphragm 304 on central region 311 of radiating surface 310.

In an aspect, planar magnetic driver 106 includes one or more magnets 314 extending around central axis 308. Speaker driver 106 can have a magnet pair including an upper magnet and a lower magnet. The magnets can be ring magnets 314. For example, a shape of magnet(s) 314 when viewed in a direction of central axis 308 can be annular. The annular shape can have an outer dimension 318 adjacent to carrier 302, and an inner dimension 320 nearer to central axis 308 than outer dimension 318. Inner dimension 320 can surround and define an acoustic opening 316. More particularly, an inner surface of magnet 314 facing central axis 308 can define a channel extending along the axis, which provides a port for sound to propagate from diaphragm 304 to a surrounding environment. Outer dimension 318 and inner dimension 320 of magnet 314 can be radially inward from carrier 302, and thus, magnet(s) 314 and acoustic opening 316 can be radially inward from mounting profile 306. Acoustic opening 316 can be located over central region 311 of radiating surface 310 on central axis 308. Accordingly, radiating surface 310 can face acoustic opening 316 to generate sound that propagates through acoustic opening 316 toward a surrounding environment or an ear of user 100 when planar magnetic driver 106 is driven with an audio signal.

In an aspect, diaphragm 304 carries several conductive traces 322. More particularly, conductive traces 322 can be formed or mounted on an upper or lower surface of diaphragm 304. Alternatively, traces 322 can be embedded within a wall of diaphragm 304. Conductive traces 322 can be located within a magnetic flux generated by the magnet(s) 314 of speaker driver 106. For example, as described below, conductive traces 322 can be positioned in a flux of opposing ring magnets. Accordingly, when an audio signal is transmitted through conductive traces 322, a combination of the magnetic flux and the electrical signal can generate a Lorentz force that acts on conductive traces 322. The Lorentz force can move diaphragm 304 to generate sound.

Referring to FIG. 4, a perspective sectional view of a planar magnetic driver is shown in accordance with an aspect. An upper magnet 314 of planar magnetic driver 106 is omitted to reveal a second (lower) magnet 314 of the driver 106. The revealed structure shows that, when viewed in cross-section, diaphragm 304 extends radially across acoustic opening 316 from a first mount 402 on mounting profile 306 to a second mount 402 on mounting profile 306. Diaphragm 304 can be clamped by the mount(s) 402 along an outer perimeter. The outer perimeter may or may not be an outer edge of diaphragm 304. For example, the outer perimeter can be a reference geometry on diaphragm 304. The outer perimeter includes the locations on diaphragm 304 that are mounted on mounts 402, and thus, the outer perimeter of diaphragm 304 is congruent with mounting profile 306 of mounts 402.

In an aspect, the first mount 402 and the second mount 402 can be diametrically opposed across mounting profile 306. Furthermore, the first mount 402 and the second mount 402 may be different locations on a same mounting structure. For example, the mounting structure can be a pair of annular pads, e.g., rubber or felt rings, that are concentrically located about central axis 308. The annular pads can extend along mounting profile 306 and can be squeezed toward each other to exert a clamping force on the outer perimeter of diaphragm 304.

When diaphragm 304 is supported by mount(s) 402, a portion of diaphragm 304 that is radially inward of mounting profile 306 can be positioned between the opposing ring magnets 314. In an aspect, magnetic flux from the opposing ring magnets 314 is directed into a magnetic gap between the magnets to interact with conductive traces 322. For example, an innermost trace 404 of conductive traces 322 can extend within the magnetic flux of one or more of the upper magnet 314 or the lower magnet 314.

In an aspect, innermost trace 404 is a trace having a radial spacing from center 312 of diaphragm 304 that is less than the radial spacings of other traces on diaphragm 304. For example, innermost trace 404 can define an inner diameter or an inner dimension (in the case of a non-circular voicecoil) of the voicecoil circuit carried on diaphragm 304. Innermost trace 404 can extend around central region 311 of radiating surface 310, e.g., innermost trace 404 can surround central region 311. Given that innermost trace 404 is the trace nearest to center 312 of diaphragm 304 and that innermost trace 404 surrounds central region 311, in an aspect, central region 311 of radiating surface 310 has no conductive traces 322. That is, no conductive traces 322 are mounted on or within diaphragm 304 over the section of radiating surface 310 corresponding to central region 311. Accordingly, central region 311 is trace-free. A moving mass of the trace-free region of diaphragm 304 can be less than a trace-carrying region of diaphragm 304, and thus, radiating surface 310 can move faster and more efficiently than a planar film having conductive traces over a central region.

By reference to the description above, it is apparent that magnet 314 defines an acoustic opening 316 through which sound propagates and innermost trace 404 defines a size of central region 311 of radiating surface 310 that generates the sound. By locating one or more of innermost trace 404 or the inner dimension 320 of magnet 314 nearer to the outer perimeter of diaphragm 304, both the acoustic opening 316 through which sound propagates and the trace-free region of diaphragm 304 can be increased.

In an aspect, innermost trace 404 and/or the inner dimension 320 of magnet 314 is located nearer to mounting profile 306 than central axis 308. For example, a first radial distance 406 between innermost trace 404 and mounting profile 306 can be less than a second radial distance 408 between innermost trace 404 and central axis 308. Similarly, a radial distance between inner dimension 320 of magnet 314 and mounting profile 306 is less than a radial distance between inner dimension 320 and central axis 308.

A ratio between first radial distance 406 and second radial distance 408 can be varied to control the size of central region 311. As the ratio decreases (as second radial distance 408 is increased), a radial dimension, e.g., a diameter, of central region 311 increases. Furthermore, as the radial dimension of central region 311 increases, so does the region of diaphragm 304 having no traces.

The ratio between first radial distance 406 and second radial distance 408 can also be varied to control the size of acoustic opening 316. As the ratio decreases, a radial dimension, e.g., a diameter, of acoustic opening 316 increases. Furthermore, as the radial dimension of acoustic opening 316 increases, the port is more open to the passage of sound generated by diaphragm 304. Accordingly, an area of sound emission can increase.

In an aspect, no acoustically opaque structures are located over acoustic opening 316. For example, an acoustically transparent mesh may extend over acoustic opening 316 (not shown), however, no magnet structures or other acoustically opaque structures are located over the opening. The acoustic radiation path through acoustic opening 316 to the surrounding environment or the ear of user 100 is not disturbed by magnets 314 or structures that carry magnets, and thus, there is less acoustic loading above or below diaphragm 304. Similarly, the direct radiating design does not have cavities in the radiation path, and thus, no unwanted resonances are generated by planar magnetic driver 106. Accordingly, planar magnetic driver 106 can emit undistorted and/or undegraded sound to the listener.

Figure 5:
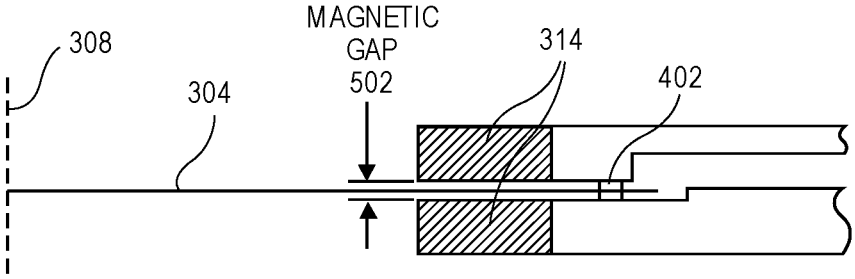
FIG. 5 is a sectional view of a diaphragm supported between a magnet pair of a planar magnetic driver, in accordance with an aspect.

Referring to FIG. 5, a sectional view of a diaphragm supported between a magnet pair of a planar magnetic driver is shown in accordance with an aspect. In cross-section, it can be seen that the upper magnet 314 and the lower magnet 314 are congruent with each other about central axis 308. In an aspect, the lower magnet 314 extends around central axis 308 concentrically with the upper magnet 314. Accordingly, the upper magnet 314 can be a ring magnet that is superposed over a lower ring magnet.

The pair of magnets are separated by a magnetic gap 502. Magnetic gap 502 is between the upper magnet and the lower magnet to provide a space through which diaphragm 304 extends. More particularly, diaphragm 304 is within magnetic gap 502 between the upper magnet and the lower magnet, and a cross-section of diaphragm 304 extends radially from central axis 308 to mount 402. In an aspect, the flat surfaces of diaphragm 304 are parallel to opposing magnet surfaces. For example, an upper surface of diaphragm 304 can be parallel to a lower surface of the upper magnet 314 facing diaphragm 304, and a lower surface of diaphragm 304 can be parallel to an upper surface of the lower magnet 314 facing diaphragm 304. Diaphragm 304 can be located midway between the lower surface of the upper magnet 314 and the upper surface of the lower magnet 314. More particularly, conductive traces 322 on the upper surface and the lower surface of diaphragm 304 can be spaced equidistantly from an opposing magnet face. The equal spacing can improve efficiency of the system by maintaining an equal force between each magnet 314 and respective conductive traces 322 during driver operation.

Figure 6:
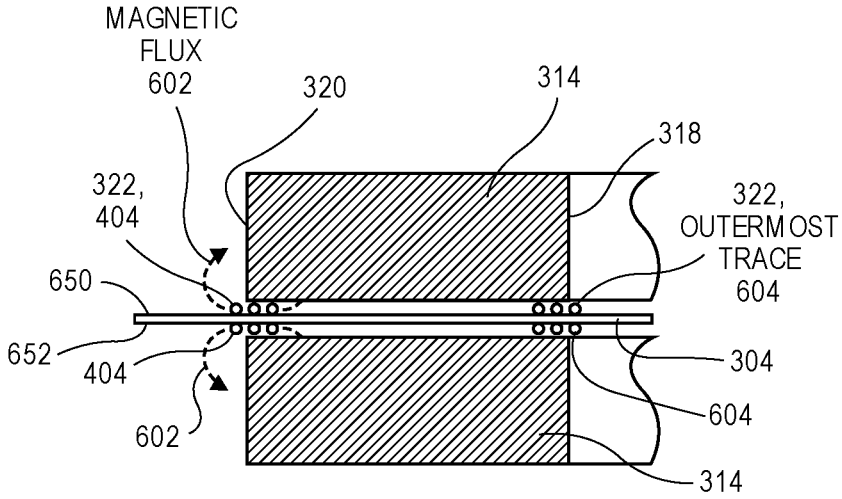
FIG. 6 is a sectional view of conductive traces on a diaphragm located within a magnetic flux of a planar magnetic driver, in accordance with an aspect.

Referring to FIG. 6, a sectional view of conductive traces on a diaphragm located within a magnetic flux of a planar magnetic driver is shown in accordance with an aspect. The magnet pair can be poled such that a magnetic flux 602 of each magnet 314 opposes the magnetic flux 602 of the other magnet 314. For example, magnetic flux 602 of the upper magnet 314 can be directed downward toward diaphragm 304, and magnetic flux 602 of the lower magnet 314 can be directed upward toward diaphragm 304.

In an aspect, diaphragm 304 is positioned within magnetic gap 502 such that conductive traces 322 on an upper surface 650 and a lower surface 652 extend within a stray flux of the opposing magnets 314. More particularly, flux lines of magnetic flux 602 can be parallel to upper surface 650 or lower surface 652 of diaphragm 304 when passing through conductive traces 322. Conductive traces 322 may be concentrated near inner dimension 320 and outer dimension 318 of magnets 314 where the flux lines extend parallel to the diaphragm surface(s). For example, innermost trace 404 on the upper surface 650 may be adjacent to inner dimension 320 of the upper magnet 314, and conductive traces 322 can include an outermost trace 604 on the upper surface 650 that is adjacent to outer dimension 318 of the upper magnet 314. Similarly, innermost trace 404 on the lower surface 652 may be adjacent to inner dimension 320 of the lower magnet 314, and conductive traces 322 can include outermost trace 604 on the lower surface 652 that is adjacent to outer dimension 318 of the lower magnet 314. Innermost traces 404 on the upper and lower surfaces 650, 652 of diaphragm 304 can be congruent, e.g., vertically aligned with each other. Accordingly, innermost trace 404 on the upper surface 650 of diaphragm 304 may be within magnetic flux 602 of the upper magnet 314, and innermost trace 404 on the lower surface 652 of diaphragm 304 may be within magnetic flux 602 of the lower magnet 314.

Figure 7:
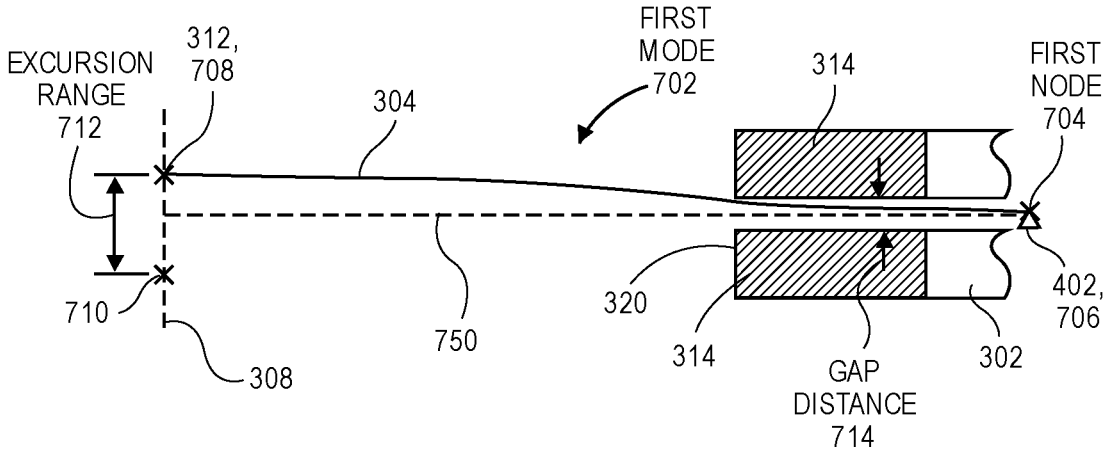
FIG. 7 is a schematic view of a diaphragm of a planar magnetic driver being driven in a first mode of vibration, in accordance with an aspect.

Referring to FIG. 7, a schematic view of a diaphragm of a planar magnetic driver being driven in a first mode of vibration is shown in accordance with an aspect. When an audio signal is transmitted through conductive traces 322, the electrical signal current combines with magnetic flux 602 to generate Lorentz forces that drive diaphragm 304. The driven diaphragm 304 can oscillate in an upward and downward direction to create one or more waves across the diaphragm. For example, when diaphragm 304 is excited in a first mode 702, a cross-section of diaphragm 304 takes a single, half-sinusoid, wave shape. In three dimensions, diaphragm 304 takes a dome shape having an apex at center 312. The dome shape may be concentrated in the central region 311 of the diaphragm, e.g., in the non-trace loaded region. The first mode shape of diaphragm 304 includes a first node 704 at the mounting location on mount 402. In any modal shape of diaphragm 304, a node point is a point over the cross-section of diaphragm 304 that resides at the rest position, e.g., along a radial plane 750 that extends between the mounting locations and parallel to the diaphragm surfaces when diaphragm 304 is at rest. The half-wave shape of diaphragm 304 in first mode 702 has a single node at mount 402, and first node 704 does not experience movement relative to the resting plane during diaphragm excitation.

In an aspect, mount(s) 402 of speaker driver 106 are revolute joints 706, and thus, mounts 402 impart a single degree of freedom between diaphragm 304 and carrier 302 at first node 704. For example, diaphragm 304 can rotate about mount 402 at first node 704, e.g., about an axis extending into the page in FIG. 7. First node 704 can be at mounting profile 306 along the outer perimeter of diaphragm 304 (near an outer dimension or circumference of diaphragm 304). Accordingly, as diaphragm 304 rotates about revolute joint 706, center 312 of diaphragm 304 can move upward and downward along the central axis 308.

Movement of center 312 along central axis 308 during diaphragm excitation is between an upper limit 708 and a lower limit 710. The distance between the limits is an excursion range 712 of diaphragm 304 along central axis 308. Given that only a surround region of diaphragm 304 is constrained between magnets 314 (not radiating surface 310 that is radially inward from the surround region), radiating surface 310 can oscillate along a range of motion having peaks higher and lower than the magnet surfaces facing diaphragm 304. That is, since magnets 314 are spaced substantially apart from central axis 308 in the radial direction, and near mounts 402, center 312 of diaphragm 304 can extend higher than the lower face of upper magnet 314 (or the upper face of lower magnet 314). Vertical movement of the region of diaphragm 304 having conductive traces 322 is constrained by magnets 314, but center 312 of diaphragm 304 is not. Accordingly, excursion range 712 of the trace-free region of radiating surface 310 can be greater than magnetic gap 502. More particularly, a gap distance 714 of magnetic gap 502 is less than an excursion range 712 of diaphragm 304 along central axis 308.

It will be appreciated that, by increasing a radial distance between central axis 308 and inner dimension 320 of magnet 314, excursion range 712 can be further increased for a same conductor movement. This can be understood, for example, with general reference to the law of similar triangles that would provide for a larger vertical leg of a triangle when a horizontal leg of the triangle is increased. Accordingly, locating innermost trace 404 and/or magnet 314 nearer to the outer perimeter of diaphragm 304 will cause a corresponding increase in excursion range 712. In any case, the deflection of center 312 of diaphragm 304 can exceed the distance between magnets 314. By maximizing the diaphragm deflection in the axial direction per unit area of diaphragm 304 in the radial direction, diaphragm 304 can displace more air volume in a smaller speaker package, and thus, sound generation of planar magnetic driver 106 can be increased.

Figure 8:
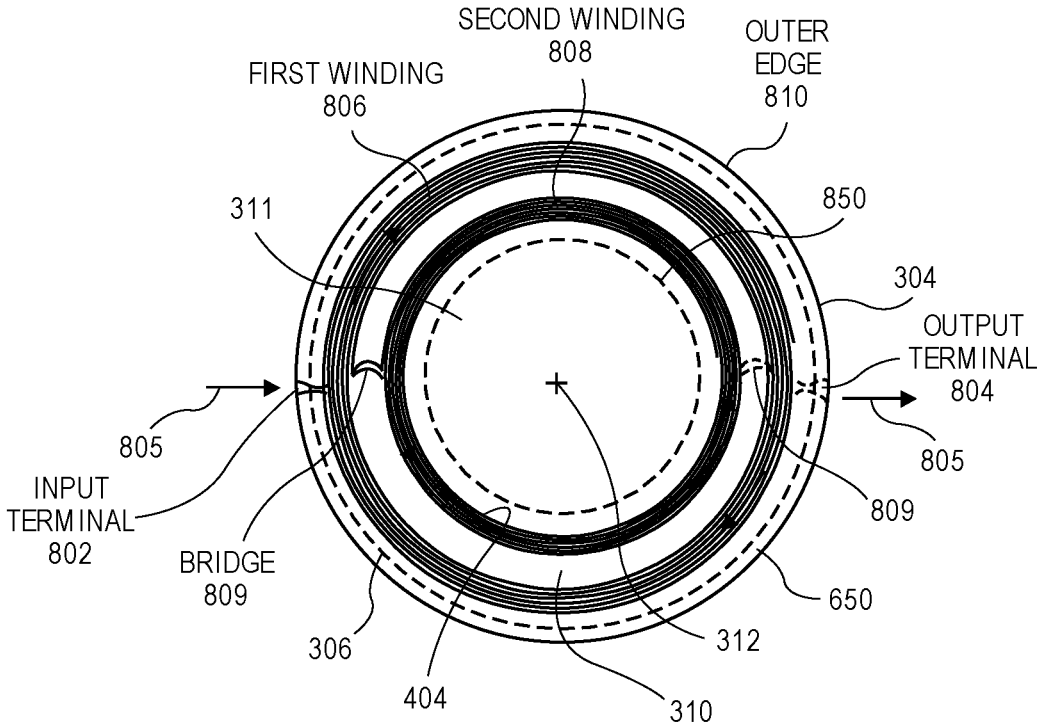
FIG. 8 is a top view of a voicecoil circuit on a diaphragm of a planar magnetic driver, in accordance with an aspect.

Referring to FIG. 8, a top view of a voicecoil circuit on a diaphragm of a planar magnetic driver is shown in accordance with an aspect. The voice coil circuit on diaphragm 304 can include a continuous electrical trace extending across one or more of the upper surface 650 or the lower surface 652 (not shown) of diaphragm 304 from an input terminal 802 to an output terminal 804. Upper surface 650 of diaphragm 304 is shown in FIG. 8, but it will be appreciated that the voicecoil circuit on upper surface 650 may be replicated on lower surface 652 of diaphragm 304. For example, a circuit on upper surface 650 may be congruent with a circuit on a lower surface 652 of diaphragm 304. An audio signal 805 can be applied to input terminal 802 and be transmitted through the voice coil circuit in the direction of the arrows over the diaphragm surfaces to output terminal 804.

The voice coil circuit can include a first winding 806 having outermost trace 604, and a second winding 808 having innermost trace 404. The winding can spiral about central axis 308 to carry electrical current in a circular fashion as shown by arrows in FIG. 8. The windings can be radially outward of central region 311 of radiating surface 310 such that central region 311 is trace-free. For example, an outer profile 850 of central region 311 can be adjacent to and radially inward of (or defined by) innermost trace 404. The windings may be electrically connected by one or more winding bridge 809 that extends across an annular gap between the first winding 806 and second winding 808. Alternatively, the windings may be combined in a single winding spiraling around central axis 308 between outermost trace 604 and innermost trace 404. As described above, both windings can be farther from center 312 of diaphragm 304 than they are from an outer edge 810 of diaphragm 304 and/or mounting profile 306 of mounts 402. For example, first winding 806 can overlap in a vertical direction with outer dimension 318 of magnet 314, and second winding 808 can overlap in the vertical direction with inner dimension 320 of magnet 314. Accordingly, outermost trace 604 can be located within magnetic flux 602 of magnet 314 near outer dimension 318, and innermost trace 404 can be located within magnetic flux 602 of magnet 314 near inner dimension 320.

Figure 9:
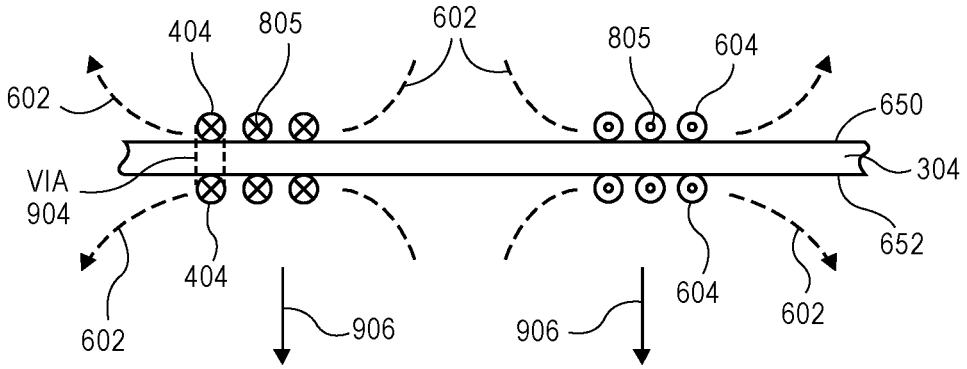
FIG. 9 is a pictorial view of a voicecoil-loaded diaphragm being moved by a Lorentz force, in accordance with an aspect.

Referring to FIG. 9, a pictorial view of a voicecoil-loaded diaphragm being moved by a Lorentz force is shown in accordance with an aspect. Audio signal 805 can include electrical current passing through conductive traces 322 on upper surface 650 and lower surface 652 of diaphragm 304. In an aspect, conductive traces 322 on upper surface 650 can be electrically coupled to conductive traces 322 on lower surface 652. For example, both conductive traces 322 can connect to input terminal 802 and extend to output terminal 804 electrically in parallel. Alternatively, conductive traces 322 on upper surface 650 can be electrically in series with conductive traces 322 on lower surface 652. For example, the voice coil circuit can include one or more vias 904 extending through diaphragm 304 from the conductive trace 322 on upper surface 650 to the conductive trace 322 on lower surface 652. In either case, innermost trace 404 on upper surface 650 can be electrically coupled to innermost trace 404 on lower surface 652.

Conductive traces 322 are shown having audio signal 805 running into the page through second winding 808 having innermost traces 404 and out of the page through first winding 806 having outermost traces 604. The direction of current flow can be combined with a direction of magnetic flux 602 of magnets 314 to determine a direction of a Lorentz force 906. For example, the illustrated direction of current flow in both innermost trace 404 and outermost trace 604 will generate a downward force 906 on diaphragm 304 according to the right-hand rule. Conversely, when the direction of current flow is reversed relative to the illustration, an upward force 906 on diaphragm 304 is generated to move diaphragm 304 upward. Accordingly, audio signal 805 can be controlled to move radiating surface 310 upward and downward to generate sound.

Diaphragm 304 is shown having a uniform thickness, however, it will be appreciated that a thickness of diaphragm 304 may be nonuniform. For example, a thickness of diaphragm 304 across central region 311 of radiating surface 310 may be greater or less than a thickness of diaphragm 304 between the outer profile of central region 311 and outer edge 810. The thicknesses can be controlled to tune movement of diaphragm 304. For example, by thinning central region 311, the surface may deflect more than the outer region of diaphragm 304 during speaker operation, which may result in central region 311 taking on a larger dome shape and displacing more air volume as compared to a uniform thickness diaphragm 304. Other tuning features can be implemented in diaphragm 304. For example, one or more weights can be mounted on diaphragm 304 at predetermined locations, e.g., at center 312 or along the outer profile of central region 311. The weights can be more dense than the diaphragm material to affect the displacement of the loaded region. The tuning features can alter the movement of diaphragm 304 during speaker operation to achieve a desired speaker output.

Figure 10:
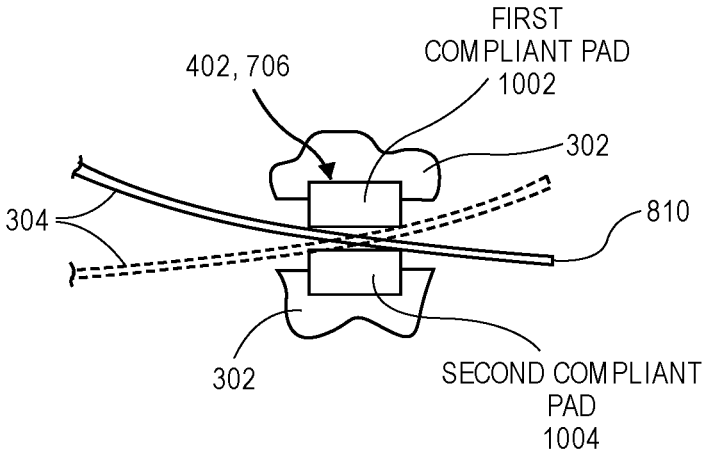
FIG. 10 is a pictorial view of a diaphragm mounted on a revolute joint of a planar magnetic driver, in accordance with an aspect.

Referring to FIG. 10, a pictorial view of a diaphragm mounted on a revolute joint of a planar magnetic driver is shown in accordance with an aspect. As described above, diaphragm 304 can be mounted on carrier 302 by revolute joints 706. The revolute joints 706 can provide more compliance to diaphragm 304 at the mounting locations as compared to other modes of joining diaphragm 304 to carrier 302, e.g., a glue joint. More particularly, whereas a glue joint would fix diaphragm 304 to carrier 302, revolute joints 706 provide a degree of freedom between diaphragm 304 and carrier 302. Accordingly, revolute joints 706 can lower the resonance frequency of diaphragm 304.

In an aspect, diaphragm 304 is clamped around mounting profile 306. For example, diaphragm 304 can be clamped between two compliant elements of mount 402. More particularly, Mount 402 may include a first compliant element and a second compliant element having respective faces that contact diaphragm 304. The elements can be pads. Diaphragm 304 can be mounted between first compliant pad 1002 and second compliant pad 1004, and pressure may be applied to diaphragm 304 by the pads to squeeze and clamp diaphragm 304 at the mounting location. The pressure may be applied by upper and lower portions of carrier 302 that are bolted together to press the compliant pads against diaphragm 304. The compliant pads can be formed from a compliant material, such as an elastomer or a felt material. Accordingly, when diaphragm 304 is excited to move center 312 along central axis 308, diaphragm 304 can rock back and forth within mount 402 and outer edge 810 of diaphragm 304 can move upward and downward. The rocking motion of diaphragm 304 at the mounting location is substantially rotational movement, e.g., tilting, and represents a degree of freedom between diaphragm 304 and carrier 302. Accordingly, the resonance frequency of diaphragm 304 is lowered, and diaphragm 304 can be more easily excited into first mode 702, and higher modes of resonance.

Figure 11:
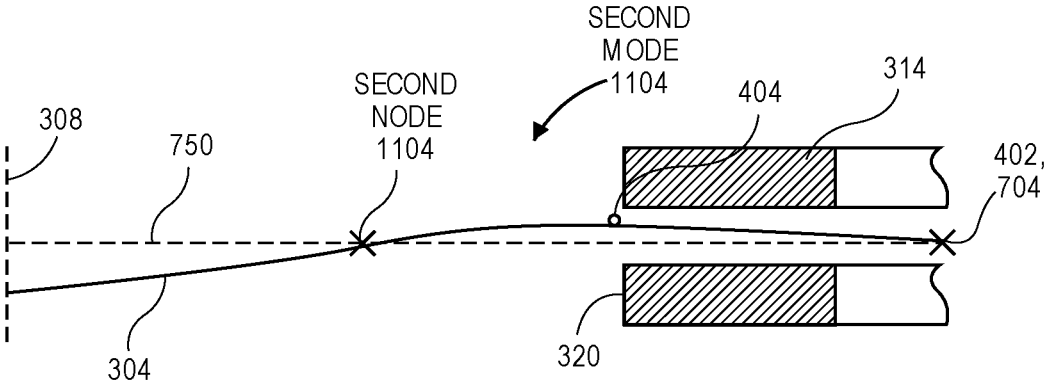
FIG. 11 is a schematic view of a diaphragm of a planar magnetic driver being driven in a second mode of vibration, in accordance with an aspect.

Referring to FIG. 11, a schematic view of a diaphragm of a planar magnetic driver being driven in a second mode of vibration is shown in accordance with an aspect. Diaphragm 304 can be excited in a second mode 1102, which is different than first mode 702. Second mode 1102 can have two nodes, one being first node 704 at mount 402 and a second node 1104 radially inward from first node 704. Like first node 704, second node 1104 is a point along the cross-section of diaphragm 304 that resides at the rest plane when diaphragm 304 has the second mode of vibration. In an aspect, second node 1104 is located between central axis 308 and magnet 314 of speaker driver 106. More particularly, inner dimension 320 of magnets 314 will reside outside of a radius of second node 1104 of diaphragm 304. Similarly, second node 1104 may be radially between innermost trace 404 on diaphragm 304 and central axis 308.

One or more regions of diaphragm 304 may be visually transparent. In an aspect, central region 311 of radiating surface 310 is visually transparent. For example, diaphragm 304 can be formed from a sheet of transparent polymer material. Given that central region 311 is trace-free, and that no magnetic structures are located above or below central region 311, forming all or a portion of radiating surface 310, e.g., central region 311, from a transparent material can allow user 100 to see through diaphragm 304. Carrier 302 or other components of planar magnetic driver 106 may also be transparent. Accordingly, speaker driver 106 can be substantially transparent and allow user 100, for example, to view a display or another object on an opposite side of speaker driver 106 from user 100. The transparency of diaphragm 304 may also provide a cosmetic benefit when used in certain products, such as when planar driver 106 is mounted in the earcup 108 of headset 104.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

In the foregoing specification, the invention has been described with reference to specific exemplary aspects thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A planar magnetic driver, comprising:

one or more mounts having a mounting profile extending around a central axis;

a magnet having an inner dimension defining an acoustic opening radially inward from the mounting profile;

a diaphragm mounted on the one or more mounts and including a cross-sectional profile extending across the acoustic opening from the mounting profile to the central axis, wherein the cross-sectional profile extends from the mounting profile to the central axis along a resting plane when the diaphragm is at rest, wherein the cross-sectional profile extends from the mounting profile to the central axis without crossing the resting plane when the diaphragm is excited in a first mode of vibration, and wherein the cross-sectional profile extends from the mounting profile to the central axis and crosses the resting plane between the central axis and the inner dimension of the magnet when the diaphragm is excited in a second mode of vibration; and a plurality of conductive traces on the diaphragm within a magnetic flux of the magnet.

2. The planar magnetic driver of claim 1, wherein the diaphragm has a single wave in the first mode of vibration, and wherein the diaphragm has a plurality of waves in the second mode of vibration.

3. The planar magnetic driver of claim 1 further comprising the resting plane extending through the mounting profile orthogonal to the central axis, wherein the magnet includes a magnet surface facing the diaphragm, wherein in the first mode of vibration and the second mode of vibration the diaphragm at the central axis is farther from the resting plane than the magnet surface.

4. The planar magnetic driver of claim 3 further comprising a second magnet having a second magnet surface separated from the magnet surface by a magnetic gap, wherein in the first mode of vibration and the second mode of vibration an excursion range of the diaphragm is larger than the magnetic gap.

5. The planar magnetic driver of claim 1, wherein in the first mode of vibration and the second mode of vibration the diaphragm at the central axis is farther from thea resting plane than an innermost trace of the plurality of traces.

6. The planar magnetic driver of claim 5, wherein the innermost trace of the plurality of traces is radially between the central axis and the inner dimension of the magnet.

7. The planar magnetic driver of claim 1 further comprising a mesh extending over a portion of the acoustic opening.

8. The planar magnetic driver of claim 1, wherein the one or more mounts are revolute joints coupling the diaphragm to a carrier.

9. The planar magnetic driver of claim 8, wherein the one or more mounts include a first compliant pad and a second compliant pad, and wherein the diaphragm is mounted between the first compliant pad and the second compliant pad.

10. The planar magnetic driver of claim 1, wherein a central region of the diaphragm is visually transparent.

11. A device, comprising:

a planar magnetic driver including one or more mounts having a mounting profile extending around a central axis, a magnet having an inner dimension defining an acoustic opening radially inward from the mounting profile, a diaphragm mounted on the one or more mounts and including a cross-sectional profile extending across the acoustic opening from the mounting profile to the central axis, wherein the cross-sectional profile extends from the mounting profile to the central axis along a resting plane when the diaphragm is at rest, wherein the cross-sectional profile extends from the mounting profile to the central axis without crossing the resting plane when the diaphragm is excited in a first mode of vibration, and wherein the cross-sectional profile extends from the mounting profile to the central axis and crosses the resting plane between the central axis and the inner dimension of the magnet when the diaphragm is excited in a second mode of vibration; and one or more processors configured to drive the planar magnetic driver with an audio signal.

12. The device of claim 11, wherein the diaphragm has a single wave in the first mode of vibration, and wherein the diaphragm has a plurality of waves in the second mode of vibration.

13. The device of claim 11 further comprising the resting plane extending through the mounting profile orthogonal to the central axis, wherein the magnet includes a magnet surface facing the diaphragm, wherein in the first mode of vibration and the second mode of vibration a center of the diaphragm on the central axis is farther from the resting plane than the magnet surface.

14. The device of claim 11 further comprising a mesh extending over a portion of the acoustic opening.

15. The device of claim 11, wherein the one or more mounts are revolute joints coupling the diaphragm to a carrier.

16. A headset, comprising:

an earcup; and a planar magnetic driver mounted in the earcup, wherein the planar magnetic driver includes one or more mounts having a mounting profile extending around a central axis, a magnet having an inner dimension defining an acoustic opening radially inward from the mounting profile, a diaphragm mounted on the one or more mounts and including a cross-sectional profile extending across the acoustic opening from the mounting profile to the central axis, wherein the cross-sectional profile extends from the mounting profile to the central axis along a resting plane when the diaphragm is at rest, wherein the cross-sectional profile extends from the mounting profile to the central axis without crossing the resting plane when the diaphragm is excited in a first mode of vibration, and wherein the cross-sectional profile extends from the mounting profile to the central axis and crosses the resting plane between the central axis and the inner dimension of the magnet when the diaphragm is excited in a second mode of vibration.

17. The headset of claim 16, wherein the diaphragm has a single wave in the first mode of vibration, and wherein the diaphragm has a plurality of waves in the second mode of vibration.

18. The headset of claim 16 further comprising the resting plane extending through the mounting profile orthogonal to the central axis, wherein the magnet includes a magnet surface facing the diaphragm, wherein in the first mode of vibration and the second mode of vibration a center of the diaphragm on the central axis is farther from the resting plane than the magnet surface.

19. The headset of claim 16 further comprising a mesh extending over a portion of the acoustic opening.

20. The headset of claim 16, wherein the one or more mounts are revolute joints coupling the diaphragm to a carrier.

* * * * *